US005946943A

United States Patent [19]

Hanson

[11] Patent Number: 5,946,943

[45] Date of Patent: Sep. 7, 1999

[54] BODY PIERCING JEWELRY

[76] Inventor: Carl Ralph Hanson, 2505 NE. 15th Ave., Portland, Oreg. 97212

[21] Appl. No.: 08/895,320

[22] Filed: Jul. 16, 1997

[51] Int. Cl.[6] ..... A44C 7/00

[52] U.S. Cl. ..... 63/12; 63/29.1; 63/31

[58] Field of Search ..... 40/301; 63/1.16, 63/3.1, 12, 13, 15.1, 23, 29.1, 31; 116/148, DIG. 12; 242/598.3, 599.3

[56] References Cited

U.S. PATENT DOCUMENTS

| | | | |
|---|---|---|---|
| 155,682 | 10/1874 | Steinheuer . | |
| D. 203,645 | 2/1966 | Koret | D8/338 |
| 241,462 | 5/1881 | Washburn . | |
| D. 267,635 | 1/1983 | Barr . | |
| D. 294,335 | 2/1988 | Gatsos . | |
| 300,488 | 6/1884 | Lehmann . | |
| D. 305,412 | 1/1990 | Zemer . | |
| 479,713 | 7/1892 | Leslie | 63/15.1 X |
| 2,713,863 | 7/1955 | Handerson . | |
| 2,769,322 | 11/1956 | Czuch . | |
| 3,051,404 | 8/1962 | Ritchey | 242/599.3 X |
| 3,345,830 | 10/1967 | Fontaine . | |
| 3,575,013 | 4/1971 | Chernow . | |
| 3,693,376 | 9/1972 | Willner | 63/29.1 X |
| 3,959,989 | 6/1976 | Bhandia | 63/31 X |
| 4,056,951 | 11/1977 | Black | 63/13 |
| 4,145,874 | 3/1979 | Muller et al. | 59/86 |
| 4,195,492 | 4/1980 | Johnson . | |
| 4,726,200 | 2/1988 | Carter | 63/31 X |
| 4,913,365 | 4/1990 | Shamass | 242/598.3 X |
| 4,928,367 | 5/1990 | Seidman . | |
| 5,044,176 | 9/1991 | King | 63/12 |
| 5,239,841 | 8/1993 | Zwart . | |
| 5,433,088 | 7/1995 | Mahar . | |
| 5,433,090 | 7/1995 | Santiago | 63/29.1 |
| 5,577,396 | 11/1996 | Cannon . | |
| 5,787,731 | 8/1998 | Ebara | 63/29.1 |

FOREIGN PATENT DOCUMENTS

| | | | |
|---|---|---|---|
| 3049481 | 7/1982 | Germany | 63/29.1 |
| 0009732 | of 1902 | United Kingdom . | |

*Primary Examiner*—Terry Lee Melius
*Assistant Examiner*—Andrea Chop
*Attorney, Agent, or Firm*—Marger Johnson & McCollom

[57] ABSTRACT

Jewelry for insertion through the bore of a body part piercing. The jewelry comprises a crescent-shaped body of a memory resilient material having terminal ends adapted to be inserted within a piercing. A concave depression is defined on an inner side of one of the terminal ends. A second body such as a ball bearing is insertable between the terminal ends and is firmly seated within the concave depression to clasp the jewelry within the piercing. The ball bearing has a diameter slightly greater than a distance between the terminal ends of the crescent-shaped body to first force the terminal ends apart and then create an inwardly directed biasing force against the second body when the ball bearing is inserted therebetween, thus firmly holding the ball bearing within the concave depression and between the terminal ends.

10 Claims, 2 Drawing Sheets

BODY PIERCING JEWELRY

BACKGROUND OF THE INVENTION

This invention relates generally to ornamental jewelry and more particularly to body piercing jewelry having a screwless clasping mechanism.

Body piercing has its roots far into the history of mankind both to indicate rites of passage in certain cultures and its use as ornamentation. To first insert a piercing, the skin would first be pierced by a sharp object forming a bore through which a stud or other type of post can be drawn through. Ornamentation can then be suspended from the post depending upon the taste of the wearer or the norms of the culture so that the ornamentation is fixed to the post by some type of clasp or other connection apparatus.

The most common type of body piercing is the earring. The earring is primarily worn as an ornamental device in that it is visible to others when worn. Examples of clasping mechanisms used in earrings are disclosed in U.S. Pat. Nos. 4,195,492 to Johnson, 5,433,088 to Mahar and 4,928,367 to Seidmann.

There is growing popularity for other types of body piercings such as those associated with parts of the body not normally visible to others. These include the navel and the sexual organs such as the breast and the penis or scrotum. The desirable elements of such piercings are not so much their use as ornamentation as they are security in the clasp, the weight of the jewelry and the feeling of the jewelry against the skin. Due to the placement of the body piercingjewelry and the size of the piercing, the jewelry is typically made from surgical stainless steel.

Examples of conventional body piercingjewelry are shown in FIGS. 1 and 2. FIG. 1 shows a conventional piercing ring at 10 which is well known in the art. The piercing ring includes a circular body 12 having a notch 14 at a top end thereof. Thus, the body is somewhat crescent-shaped. A threaded bore 16 extends through one end of the notch. A spherical stop 18 includes a radially extending screw 20 which is received within bore 16.

In use, the spherical stop 18 is unscrewed from the bore 16 and the body 12 is slid through a pierced hole in the body and out the other end. The stop 18 is then screwed into the bore and the resulting piercing ring then hangs freely from the body part.

FIG. 2 shows an alternate type of piercing ring at 30 which is also well known in the art. Piercing ring 30 includes a circular body 32 having a notch 34 spanned by threaded ends 36,38 which make the body appear somewhat crescent-shaped. A pair of spherical stops 40,42 (each having an interiorly threaded bore such as bore 44) are threaded onto ends 36,38 once the ring has been slipped through the body piercing.

These types of conventional body piercing rings have several noted disadvantages within certain elements of the piercing community. First, they entail screw type mechanisms which require a circularly cross-sectioned body. Thus, as the weight of the jewelry increases, the body cross section necessarily increases until it no longer can be received through the pierced hole. A second disadvantage of using screw-type mechanisms is the time it takes to engage and disengage the stops for insertion and removal of the jewelry. Finally, insertion of the screw-type clasps can result in a deposit of dirt or other material on the screw threads thus decreasing the effectiveness of the clasp.

Accordingly, a need remains for a simplified clasping mechanism for use with body piercing jewelry.

SUMMARY OF THE INVENTION

It is, therefore, an object of the invention to screwlessly secure a detachable weight to a piercing.

The invention comprises jewelry adapted for insertion through the bore of a body part piercing. The jewelry comprises a crescent-shaped body of a memory resilient material having terminal ends adapted to be inserted within a piercing. A concave depression is defined on an inner side of one of the terminal ends. A second body such as a ball bearing is insertable between the terminal ends and is firmly seated within the concave depression to clasp the jewelry within the piercing. The ball bearing has a diameter slightly greater than a distance between the terminal ends of the crescent-shaped body to first force the terminal ends apart and then create an inwardly directed biasing force against the second body when the ball bearing is inserted therebetween, thus firmly holding the ball bearing within the concave depression and between the terminal ends.

The foregoing and other objects, features and advantages of the invention will become more readily apparent from the following detailed description of a preferred embodiment of the invention which proceeds with reference to the accompanying drawings.

DETAILED DESCRIPTION

The present invention illustrates, in FIGS. 3–11, alternate embodiments of the invention. Each of these embodiments is preferably formed of a material such as 316L surgical stainless steel which decreases the chance of infection within the piercing. Such a material is memory resilient when deflected a small amount from its rest configuration as will be appreciated by the operation of the novel clasping mechanism described below.

Figure 1:
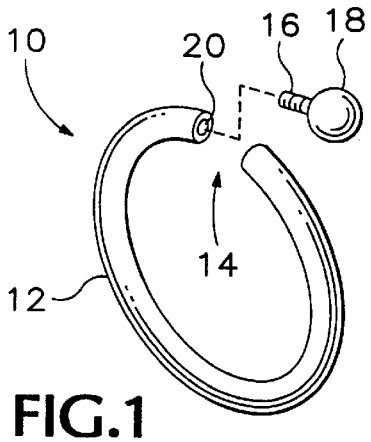
FIG.1 PRIOR ART
FIG. 1 is a perspective view of a one type of body piercing jewelry known in the prior art.
Figure 2:
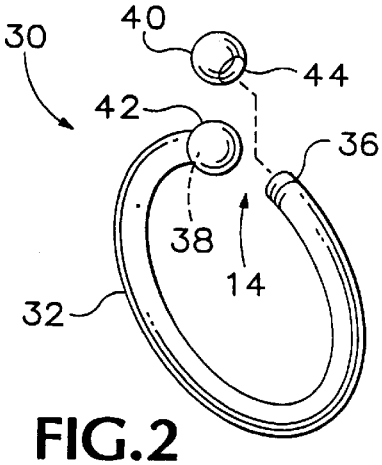
FIG.2 PRIOR ART
FIG. 2 is a perspective view of another type of body piercing jewelry known in the prior art.
Figure 3:
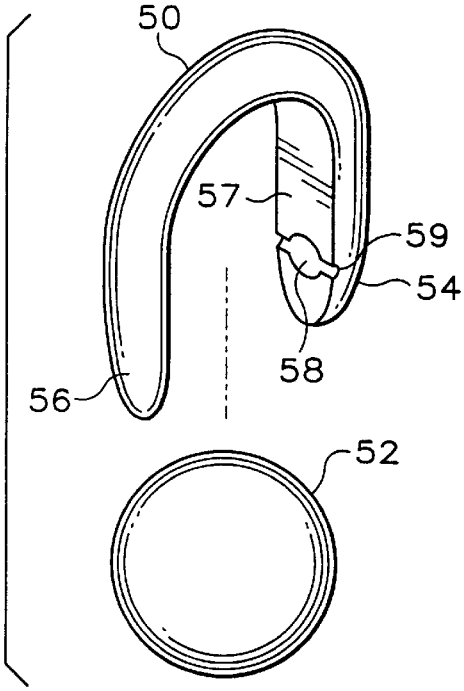
FIG. 3 is an exploded perspective view of a type of body piercing jewelry constructed according to a first embodiment of the invention.
Figure 4:
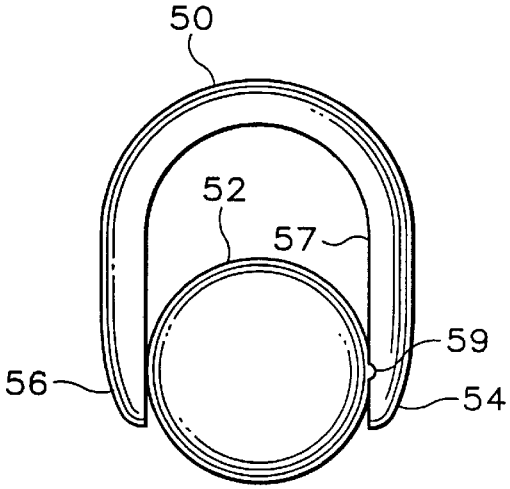
FIG. 4 is a front elevation view of the body piercing jewelry of FIG. 3.

FIGS. 3 and 4 show body piercing jewelry constructed according to a first embodiment of the invention. FIGS. 3 and 4 respectively illustrate a second body, such as spherical ball bearing 52, exploded out from and inserted in a first crescent-shaped body, such as inverted U-shaped ring 50. The ball bearing 52 is preferably formed of a harder metal than the first body 50, such as 440C stainless steel. Ring 50 terminates in two ends 54,56 which are spaced apart slightly less than the diameter of ball bearing 52. A circular concave depression 58 is defined on an inner side 57 of one end 54 as by grinding or molding.

Figure 5:
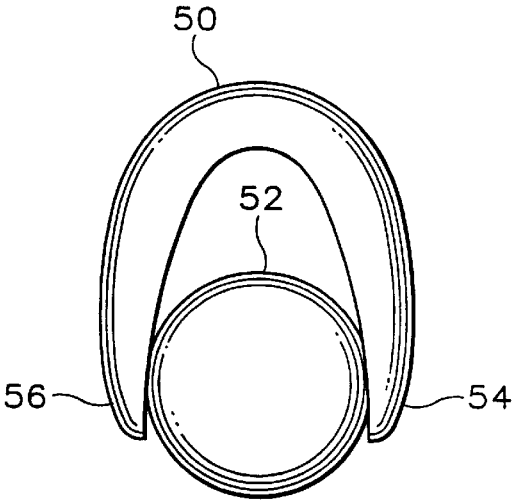
FIG. 5 is a front elevation view of a type of body piercing jewelry constructed according to a second embodiment of the invention.

FIG. 5 shows a second embodiment of the jewelry. All elements of the type of FIGS. 3 and 4 are also included in FIG. 5 with the exception of groove 59. However, it is noted that the inner surfaces of the ends 54,56 are angled away from one another, such as in a parabolic curve. This is different from the type of FIGS. 3 and 4 in which the inner surfaces of ends are parallel to one another. It is to be understood that the inner surfaces could also be angled toward one another.

Figure 6:
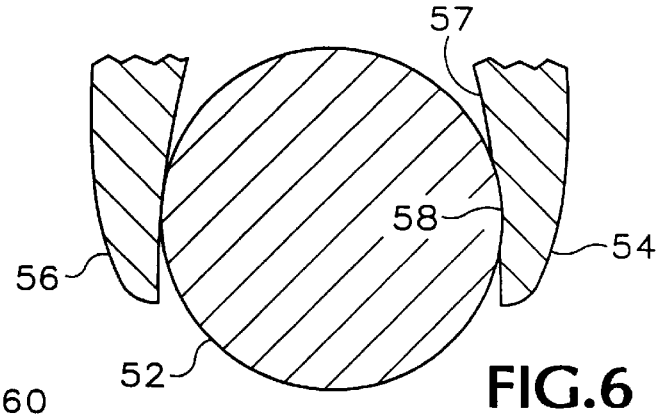
FIG. 6 is a sectional view of body piercing jewelry of FIG. 5.

FIG. 6 shows a sectioned view of captured ball bearing 52 between ends 54,56 of the body piercing jewelry of FIG. 5. One side of ball bearing 52 is in contact with the inner surface of end 56 while an opposite side of ball bearing 52 is settled within the concave depression 58 defined on the inner side of end 54. In a preferred embodiment, the concave depression 58 has a substantially similar curvature as the ball bearing 52 to effect a snug fit and greater area of contact. However, the concave depression can be either of a greater curvature—in which case the ball bearing 52 contacts the circular edge of depression 58—or the concave depression can be of a lesser curvature—in which case the call bearing contacts the central depressed area of depression 58.

In use, one of the terminal ends 54,56 is inserted within a piercing (not shown) and rotated downward so that the central part of ring body 50 is received within the piercing with the terminal ends point downward. The terminal ends 54, 56 are preferably tapered to facilitate this insertion within the piercing. Then, the ball bearing is 52 pressed between the ends 54,56 until it settles within depression 58 as shown in FIGS. 4–6 to thereby form a closed assembly that can be maintained within the piercing. Due to the curvature of the ball bearing, the ends 54,56 are forced apart until the ball bearing fits between them. Insertion of the ball bearing 50 between the terminal ends of the ring body can be facilitated by including a first groove 59 that is coextensive with the inner side 57 of terminal end 54 and extends across the concave depression. Additionally, the edges of inner side 57 can be rounded to further facilitate insertion of the ball bearing between the ring body terminal ends.

Because of the resiliency of the material used to form ring body 50, an inwardly directed biasing force against the second body is created when the ball bearing is inserted between the terminal ends 54,56. This biasing force can be regulated by the type of material used for the ring body 50, the thickness of the ring body terminal ends 54, 56, and the amount the ends are deflected when the ball bearing 52 is seated within the concave depression 58. For instance, the concave depression could be deeply ground into the inner side of the ring body so that the distance between the base of the concave depression and the opposing terminal side of the body is slightly greater than the diameter of the ball bearing inserted therebetween. In this instance, the ball bearing can rotate within the depression but is still firmly maintained between the terminal ends. Thus stably seated within the concave depression, the ball bearing acts like a suitable weight which is apparently desirable in the body piercing community. Differently weighted and shaped bodies could be placed between the terminal ends of the ring body 50 depending upon the desires of the user provided, however, that the second body has ends adapted to fit in an inserted position between the concave depression of the first of the inner sides and the second inner side (as with FIGS. 7 and 8 described below).

Figure 7:
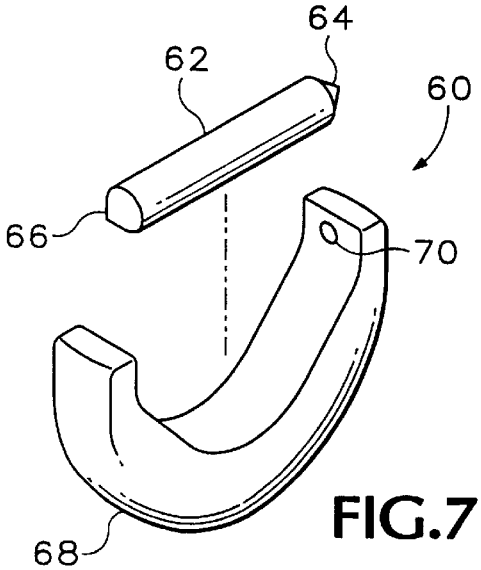
FIG. 7 is an exploded perspective view of a type of body piercing jewelry constructed according to a third embodiment of the invention.
Figure 8:
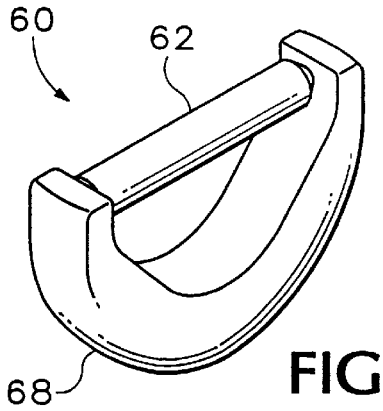
FIG. 8 is a perspective view of the body piercing jewelry of FIG. 7.

FIGS. 7 and 8 show a third embodiment of the body piercing jewelry at 60 having a horizontal piercing rod 62 with tapered ends 64, 66. Rod 62 has a preferred circular cross-section. Piercing device 60 also includes a semicircular or crescent-shaped clapper ring 68 having a depression (such as at 70) at each inner terminal end of ring 68. The rod 62 has a length approximately equal to or slightly less than a distance between the base of the depressions. When the rod 62 is inserted through the piercing and the ring 68 snapped on, the ring has a pendulum swinging movement which is also a desired aspect in the piercing community. Preferably, the tapered ends 64, 66 terminate in rounded points.

Figure 9:
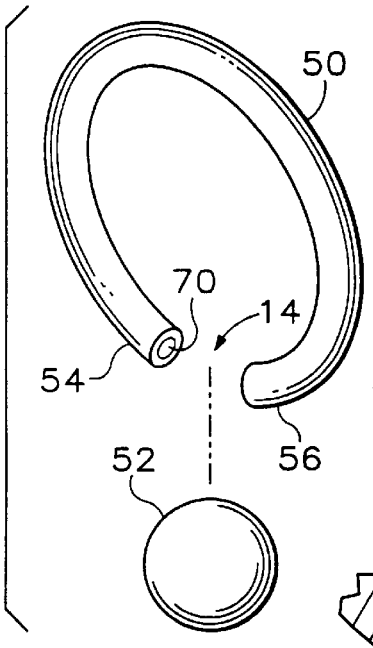
FIG. 9 is an exploded perspective view of a type of body piercing jewelry constructed according to a fourth embodiment of the invention.
Figure 10:
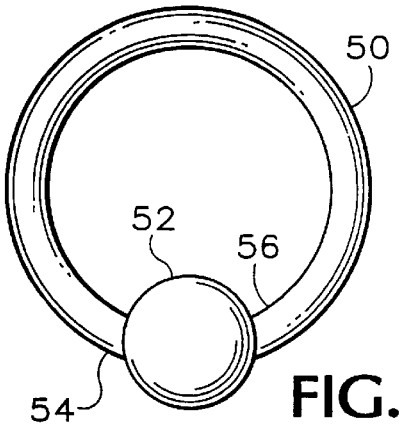
FIG. 10 is a front elevation view of the body piercing jewelry of FIG. 9.
Figure 11:
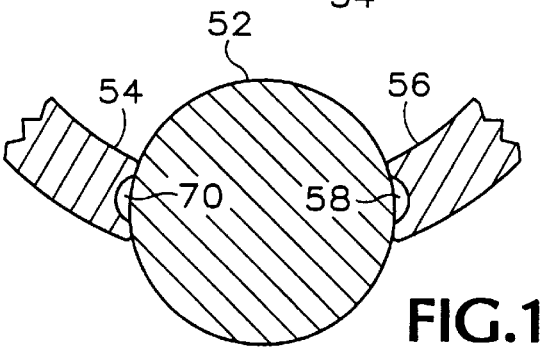
FIG. 11 is a sectional view of body piercing jewelry of FIG. 10.

FIG. 9 is an exploded perspective view of a type of body piercing jewelry constructed according to a fourth embodiment of the invention. The jewelry includes a thinner crescent-shaped ring 50 with a notch 14 separating substantially opposing terminal ends 54, 56. Concave depressions are defined in the inner side of each terminal end, such as depression 70 in end 54. When the second body (e.g. ball bearing 52) is inserted between the body terminal ends, the body is captured between the two concave depressions 58,70 (see FIGS. 10 and 11). As with the previous embodiments, the size of the second body relative to the notch opening of the first body creates a biasing force when the jewelry is assembled.

The present invention offers several advantages over prior art body piercingjewelry assemblies. No sharp surfaces are needed to firmly clasp the jewelry within the body piercing. Consequently, there is less chance for dirt to be trapped. Furthermore, the detachable jewelry described herein is easier to clean and disinfect than screw-based systems known in the prior art.

Having described and illustrated the principles of the invention in a preferred embodiment thereof, it should be apparent that the invention can be modified in arrangement and detail without departing from such principles. I claim all modifications and variation coming within the spirit and scope of the following claims.

I claim:

1. Jewelry for insertion through the bore of a body part piercing comprising:

a crescent-shaped body of a memory resilient material having terminal ends adapted to be inserted within a piercing;

a concave depression defined on an inner side of one of the terminal ends by a peripheral edge;

a ball bearing having a diameter slightly greater than a distance between the terminal ends of the crescent-shaped body, said ball bearing being insertable between the terminal ends and firmly seated within the concave depression; and a first groove extending radially from said concave depression and across the peripheral edge along the inner side of said one of the terminal ends to facilitate insertion of the ball bearing between the terminal ends and seating of the ball bearing within the concave depression.

2. The jewelry according to claim 1 wherein said terminal ends are substantially parallel to one another.

3. The jewelry according to claim 1 wherein said terminal ends are substantially outwardly depending from one another.

4. The jewelry according to claim 1 wherein said concave depression has a diameter approximately equal to the diameter of the ball bearing.

5. The jewelry according to claim 1 wherein said concave depression has a diameter less than the diameter of the ball bearing.

6. The jewelry according to claim 1, further including a second concave depression defined on an inner side of a second one of the terminal ends.

7. Body piercing jewelry comprising:

a first body having opposingly faced first and second inner sides located on respective terminal ends of the first body;

a concave depression defined on the first of the inner sides by a peripheral egde;

a first groove extending radially from said concave depression and across the peripheral edge along the first of the inner sides; and a spherical body adapted to fit in an inserted position between the concave depression of the first of the inner sides and the second inner side to thereby form a closed assembly with the first body that can be maintained within a piercing.

8. The jewelry according to claim 7 wherein said terminal ends of said first body are substantially parallel to one another.

9. The jewelry according to claim 7 wherein said terminal ends of said first body are substantially outwardly depending from one another.

10. The jewelry according to claim 7, further including a second concave depression defined on the second of the inner sides of the first body adapted to receive the spherical body when in the inserted position.

* * * * *